US007142079B2

(12) United States Patent
Chang

(10) Patent No.: US 7,142,079 B2
(45) Date of Patent: Nov. 28, 2006

(54) TRANSFORMER STRUCTURE

(75) Inventor: Shih-Hsien Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 57 days.

(21) Appl. No.: 10/982,353

(22) Filed: Nov. 5, 2004

(65) Prior Publication Data

US 2005/0140485 A1 Jun. 30, 2005

(30) Foreign Application Priority Data

Dec. 26, 2003 (TW) ..... 92137174 A

(51) Int. Cl.
*H01F 27/02* (2006.01)

(52) U.S. Cl. ..... 336/90; 336/198; 336/208

(58) Field of Classification Search ..... 336/208, 336/198, 192, 90
See application file for complete search history.

(56) References Cited

U.S. PATENT DOCUMENTS 3,909,761 A * 9/1975 Miles ..... 336/192
4,405,913 A * 9/1983 Finkbeiner ..... 336/98
4,716,394 A * 12/1987 Gordon ..... 336/192
6,587,023 B1 * 7/2003 Miyazaki et al. ..... 336/83
6,734,777 B1 * 5/2004 Yeh et al. ..... 336/208

FOREIGN PATENT DOCUMENTS

JP 2-106007 * 4/1990
JP 10074634 3/1998

* cited by examiner

*Primary Examiner*—Anh Mai
(74) *Attorney, Agent, or Firm*—Madson & Austin

(57) ABSTRACT

A transformer structure is proposed herein which includes a primary winding coil, a secondary winding coil, a bobbin module, and a magnetic core assembly. The magnetic core assembly is mounted within the bobbin module. The bobbin module includes a first winding window portion and a second winding window portion in which the first winding window portion allows the primary winding coil to be wound thereupon and the second winding window portion allows the secondary winding coil to be wound thereupon. Both of first winding window portion and the second winding window portion include a first lateral plate, and each couples or separate with each other by the first lateral plate, such that the primary winding coil and the secondary winding coil are separated with each other and the leakage inductance, and the safe distance of electrical security for the transformer is increased accordingly.

10 Claims, 5 Drawing Sheets

TRANSFORMER STRUCTURE

FIELD OF THE INVENTION

The present invention is related to a transformer structure, and more particularly to a transformer structure with an increased leakage inductance, an improved electrical security, a simpler construction, less manpower for assembling, and a reduced manufacturing cost.

BACKGROUND OF THE INVENTION

Transformer has been widely introduced into a variety of electric appliances as a basic circuit component. Referring to FIG. 1, which shows a typical representation of a conventional transformer structure. As shown in FIG. 1, a conventional transformer 1 includes a magnetic core assembly 11, a bobbin 12, a primary winding coil 13, and a secondary winding coil 14. The primary winding coil 13 and the secondary winding coil 14 are wound up and down in the winding area within the bobbin 12, and are separately isolated by a tape 15. The magnetic core assembly 11 is generally shaped in the form of an EE-core, an EI-core, or an ER-core, wherein a central leg 111 thereof is mounted in the hollow 121 of the bobbin 12 so that the magnetic core assembly 11 can achieve a magnetic coupling effect with the primary winding coil 13 and the secondary winding coil 14, and thereby perform voltage transformation.

The regulation on the leakage inductance of a transformer is an important factor for a power converter. This is because the leakage inductance of a transformer would influence the power conversion efficiency of a power converter. In order to improve the power conversion efficiency of a power converter, enormous efforts has been paid to strive for the increase of the coupling coefficient of the transformer windings, the reduction of leakage inductance, and the abatement of the power loss during voltage transformation process. In the transformer structure of FIG. 1, the primary winding coil 13 and the secondary winding coil 14 are wound up and down in the winding area within the bobbin 12, and thus the magnetic leakage induced between the primary winding coil 13 and the secondary winding coil 14 is lower, while the coupling coefficient is increased and the power loss during the voltage transformation process is abated. In this way, the power conversion efficiency of a power converter is improved.

However, the power supply system adapted for the new generation electronic product, such as LCD TV, incorporates a transformer with a leakage inductance as a mainstream circuit design rule. The current circulating in the power supply system generally flows through a LC resonant circuit comprising a leakage inductor L and a capacitive element C. In the meantime, a current having a quasi-semisinusoidal waveform flows through a field-effect transistor (FET) switch. When the current value is zero, the FET switch is turned on. After a period of a semi-sinusoidal waveform is elapsed and the current value returns to zero, the FET switch is turned off. Using such soft switch design with a resonant circuit, the switching loss and the noise of the switching element can be degenerated.

There are various ways to increase the leakage inductance of a transformer. The most common way to increase the leakage inductance of a transformer is to separate the primary winding coil and the secondary winding coil by a specific distance in order to decrease the coupling coefficient, and thereby increase the leakage inductance of a transformer. Referring to FIG. 2, a conventional transformer with a leakage inductance is shown. As shown in FIG. 2, the transformer 2 includes a bobbin 21, a primary winding coil 22, a secondary winding coil 23, and a tape 24, in which the bobbin 21 includes a first lateral plate 211, a second lateral plate 212, and a winding window portion 213. The tape 24 is wound up substantially in the middle of the winding window portion 213 and has a width d, so that the winding window portion 213 is divided into a first winding area 2131 and a second winding area 2132. The primary winding coil 22 and the secondary winding coil 23 are wound around the first winding area 2131 and the second winding area 2132, respectively, and are respectively separated from the first lateral plate 211 and the second lateral plate 212 by a first lateral tape 25 and a second lateral tape 26. By way of the isolation effect provided by the tape 24, a constant distance of electrical security can be maintained between the primary winding coil 22 and the secondary winding coil 23. In addition, a safe distance of electrical security can be maintained between the primary winding coil 22, the secondary winding coil 23 and the external conductor through the use of the lateral tapes 25 and 26. Furthermore, the larger the width of the tape 24 is, the lower the coupling coefficient of the transformer will be, and the larger the leakage inductance of the transformer will be. This would favor the regulation on the resonant circuit of the power supply system.

Although the transformer structure shown in FIG. 2 can increase the leakage inductance of transformer, there still exists numerous problems needing to be conquered. For example, the magnitude of the leakage inductance depends on the width of the tape 24 which is wound around the primary winding coil 22 and the secondary winding coil 23. Because the tape 24 is a soft material and is not possible to be thoroughly affixed, the transformer windings would bear a weak structure and would be susceptible to displacement after a long usage time. This would lead to a lower or unstable leakage inductance, and would further affect the regulation on the resonant circuit of the power supply system. Moreover, the arrangement of using the tape 24, the first lateral tape 25 and the second lateral tape 26 as an isolator requires onerous labor work to wind the tapes. Since the tape has viscosity and has a relatively small width, the laboring efforts expended on tape winding will be time-consuming and complicated. This would limit the promotion of yield and cause wastes on manpower and cost. Also, the quality of transformer would be seriously deteriorated due to the improper winding of the tapes.

More disadvantageously, because it is necessary to wind the tape 24, the first lateral tape 25 and the second lateral tape 26 around the winding window portion 213 of the bobbin 21, the area and capacity in which the primary winding coil 22 and the secondary winding coil 23 can occupy within the winding window portion 213 are significantly reduced, and the heat-dissipating performance of the transformer is worsened accordingly. Further, when the winding process and the taping process are finished, an additional tape is needed to be further coated on the primary winding coil 22 and the secondary winding coil 23 for the purpose of isolation. This would aggravate the poor heat-dissipating efficiency of the primary winding coil 22 and the secondary winding coil 23. What is worse, as the melting point of the tape is relatively low, the maximum operating temperature of transformer is unavoidably limited, resulting in a narrow applicability for the transformer.

Accordingly, there is an urgent need to develop a transformer with a leakage inductance that can overcome the deficiencies and difficulties encountered by the prior art.

SUMMARY OF THE INVENTION

A first object of the present invention is to provide a transformer structure by separating the primary winding coil and the secondary winding coil thereof to decrease the coupling coefficient and increase the leakage inductance. The transformer structure according to the present invention is advantageous in terms of a uncomplicated circuit arrangement, and is capable of upgrading the electricity security, simplifying the manufacturing procedure, and saving the laboring effort and manufacturing cost.

To this end, a preferred embodiment of the present invention provides a transformer structure which at least includes a primary winding coil, a secondary winding coil, a bobbin module, and a magnetic core assembly. The magnetic core assembly is mounted in the bobbin module, and the bobbin module includes a first winding window portion and a second winding window portion. The first winding window portion is used to allow the primary winding coil to be wound thereupon, and the second winding window portion is used to allow the secondary winding coil to be wound thereupon. Both of the first winding window portion and the second winding window portion include a first lateral plate, and the first winding window portion and the second winding window portion are separated or coupled with each other by lateral plates thereof so as to separate the primary winding coil and the secondary winding coil.

In accordance with a practical aspect of the present invention, the first winding window portion and the second winding window portion are integrally formed.

In accordance with a practical aspect of the present invention, the bobbin module further includes a bobbin case for sheathing the first winding window portion and the second winding window portion.

In accordance with a practical aspect of the present invention, the bobbin case includes at least two chambers being respectively corresponding to the first winding window portion and the second winding window portion for covering the first winding window portion and the second winding window portion.

In accordance with a practical aspect of the present invention, the chambers of the bobbin case are separated with each other by a partition plate.

In accordance with a practical aspect of the present invention, the partition plate is fittingly positioned in the gap formed between the first lateral plate of the first winding window portion and the first lateral plate of the second winding window portion.

In accordance with a practical aspect of the present invention, the bobbin module further includes a bottom plate extending upwardly to form a flange that is fittingly positioned in the gap formed between the first lateral plate of the first winding window portion and the first lateral plate of the second winding window portion.

In accordance with a practical aspect of the present invention, the bobbin case further includes two openings which are respectively communicable with the chambers for dissipating the heat generated by the primary winding coil and the secondary winding coil.

In accordance with a practical aspect of the present invention, both of the first winding window portion and the second winding window portion include a second lateral plate.

In accordance with a practical aspect of the present invention, for each first winding window portion and second winding window portion there is provided a winding area formed between a first lateral plate thereof and a second lateral plate thereof.

In accordance with a practical aspect of the present invention, a lower part of the second lateral plate is configured to extend outwardly to form a contact pin portion.

In accordance with a practical aspect of the present invention, the contact pin portion is provided with a plurality of contacts.

In accordance with a practical aspect of the present invention, the first winding window portion and the second winding window portion are separated with each other.

In accordance with a practical aspect of the present invention, the primary winding coil and the secondary winding coil are respectively coated with a sheathing.

In accordance with a practical aspect of the present invention, the magnetic core assembly is shaped in the form of an EE-core, an EI-core, an ER-core, or a UU-core.

Now the foregoing and other features and advantages of the present invention will be best understood through the following descriptions with reference to the accompanying drawings, wherein:

BRIEF DESCRIPTION OF THE DRAWINGS

FIG. 3(*b*) illustrates a transformer structure with a leakage inductance according to another preferred embodiment of the present invention.

DETAILED DESCRIPTION OF THE PREFERRED EMBODIMENT

Figure 1:
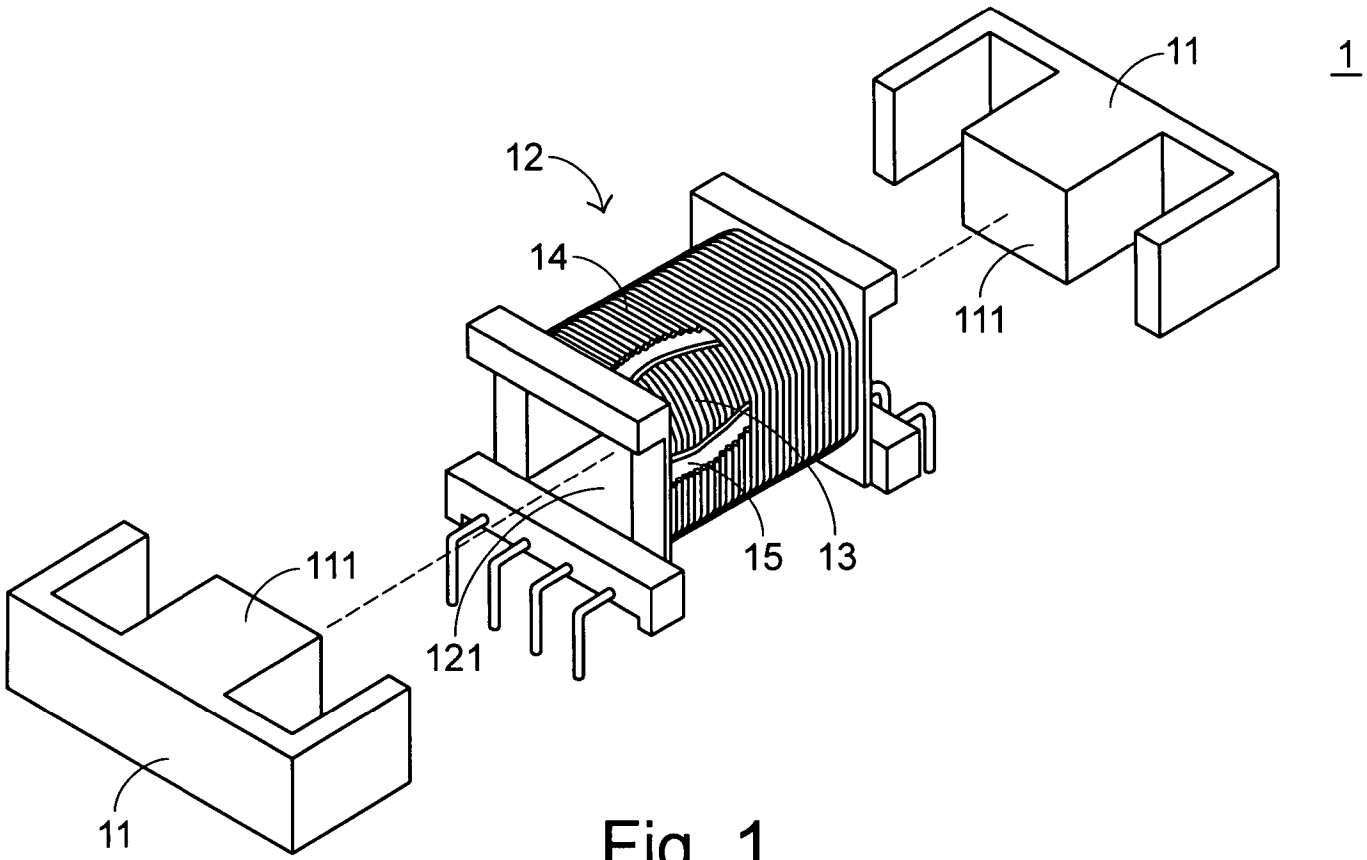
Fig. 1 (Prior Art)
FIG. 1 is a typical representation of a conventional transformer structure.
Figure 2:
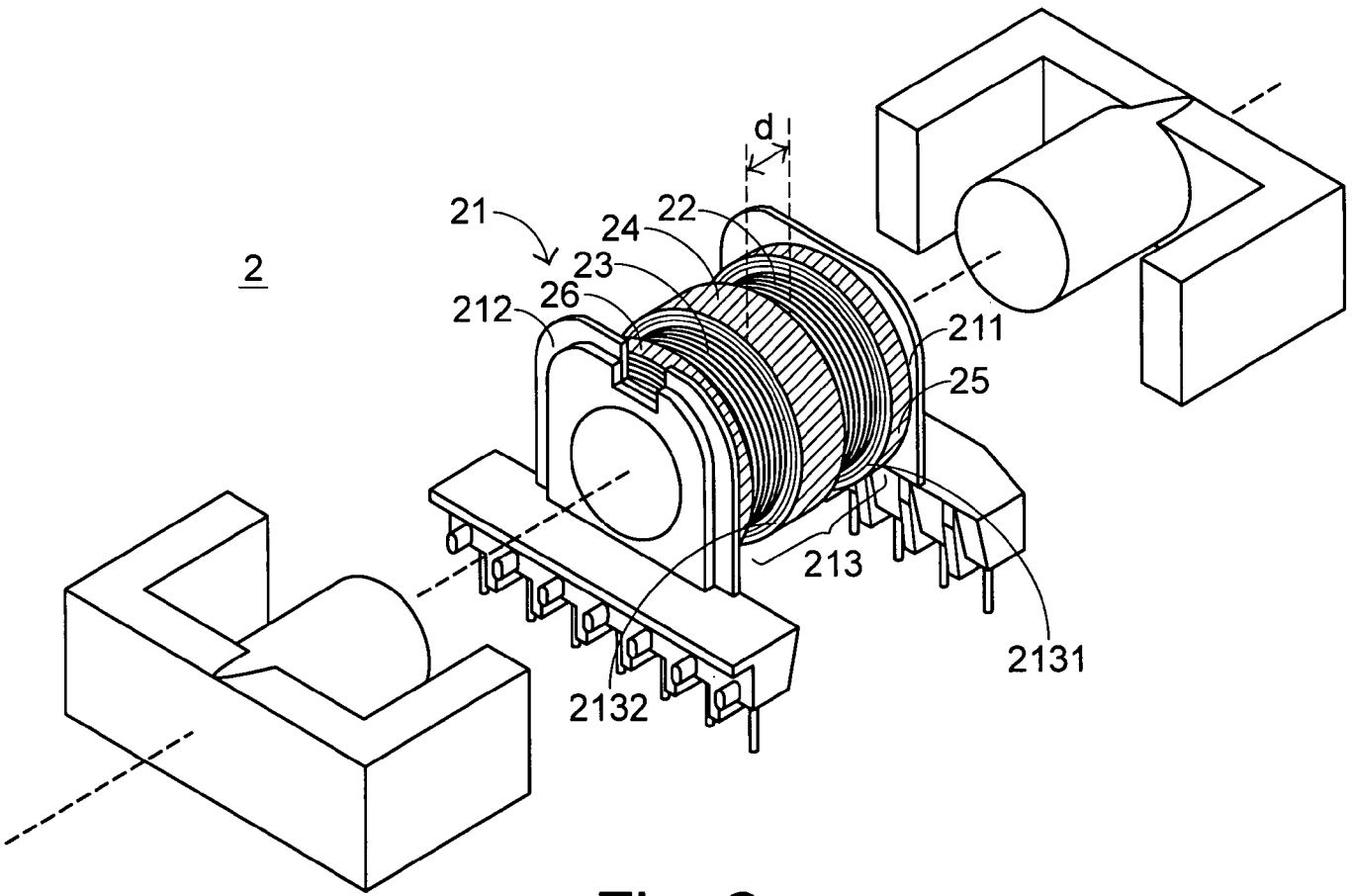
Fig. 2 (Prior Art)
FIG. 2 is a typical representation of a conventional transformer structure with a leakage inductance.
Figure 3A:
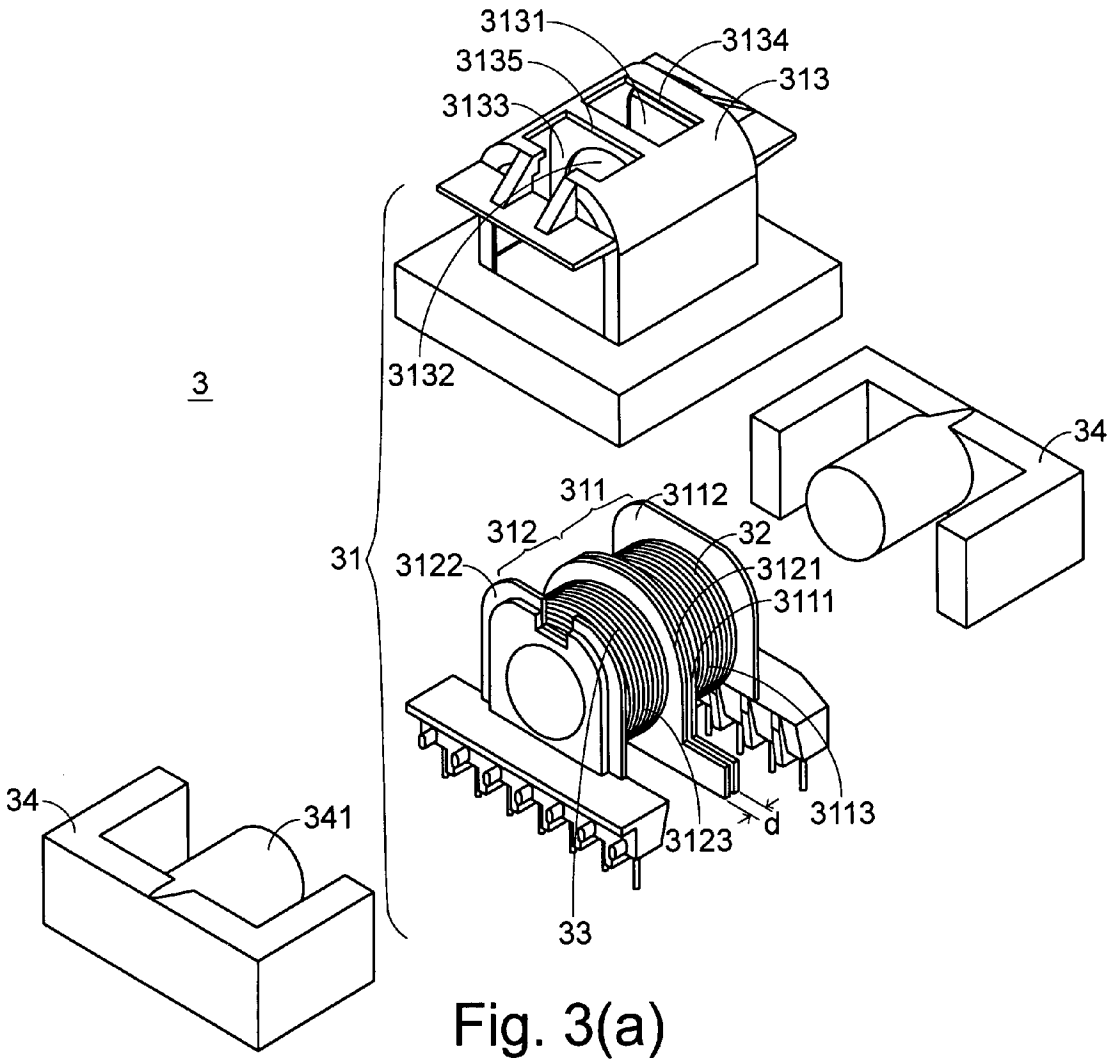
FIG. 3(*a*) illustrates a transformer structure with a leakage inductance according to a preferred embodiment of the present invention.
Figure 3B:
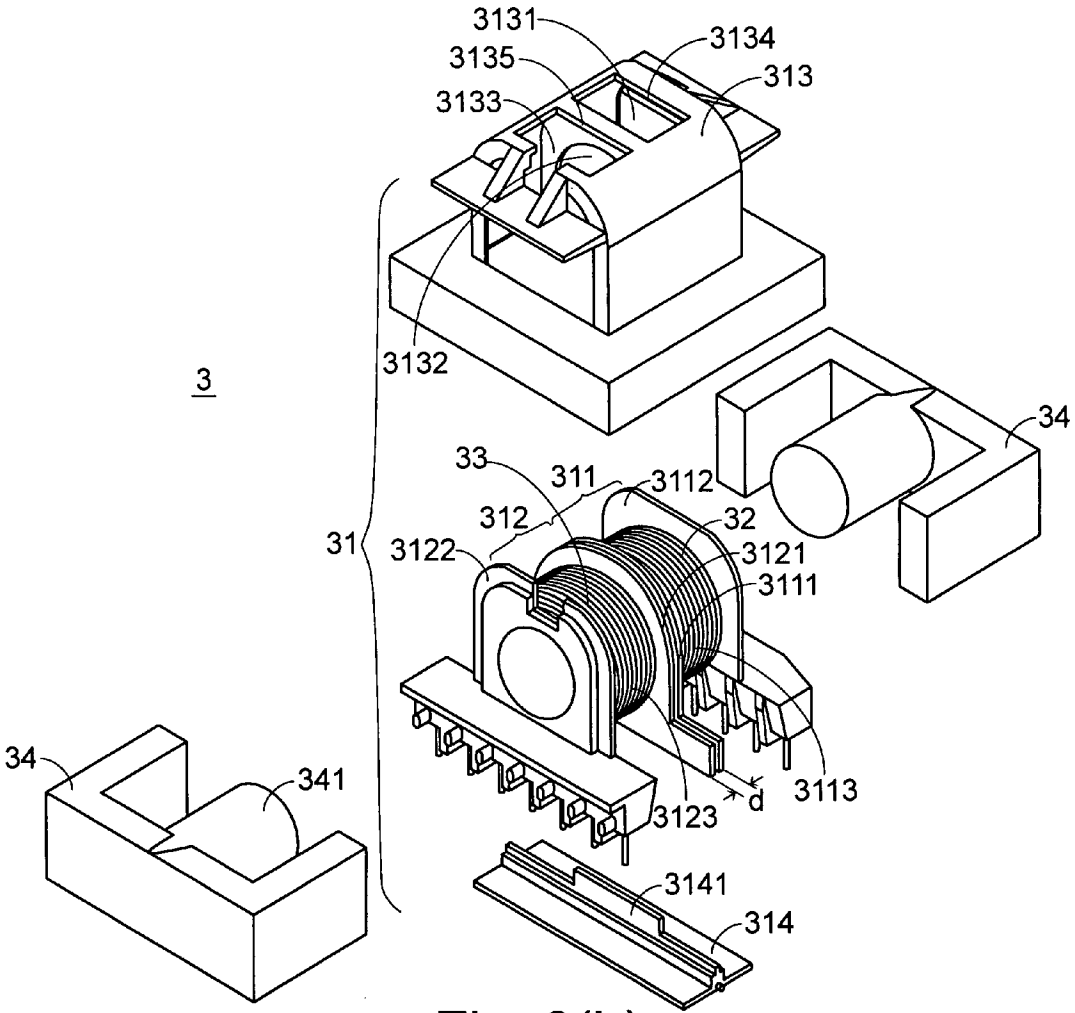

Referring to FIG. 3(*a*), which shows a transformer structure with a leakage inductance according to a preferred embodiment of the present invention. As shown in FIG. 3(*a*), the transformer according to the present invention is constituted by a bobbin module 31, a primary winding coil 32, a secondary winding coil 33, and a magnetic core assembly 34. The bobbin module 31 includes a first winding window portion 311, a second winding window portion 312, and a bobbin case 313. The primary winding coil 32 and the secondary winding coil 33 are wound around the first winding window portion 311 and the second winding window portion 312, respectively. The magnetic core assembly 34 can be shaped in the form of an EE-core, an EI-core, or an ER-core, in which a central leg 341 thereof is mounted within the bobbin module 31 so that the magnetic core assembly 34 can achieve a magnetic coupling effect with the primary winding coil 32 and the secondary winding coil 33, and thereby perform voltage transformation.

Reference numerals are now made to FIG. 3(*a*), wherein the first winding window portion 311 and the second winding window portion 312 of the bobbin module 31 respectively includes a first lateral plate 3111,3121 and a second lateral plate 3112,3122, in which winding areas 3113,3123 are individually formed in the gap between the first lateral plate 3111,3121 and the second lateral plate 3112,3122. In addition, the lower part of the second lateral plate 3112,3122 within the winding window portion 311,312 is extended outwardly to form a contact pin portion with a plurality of contact pins for allowing the contact pins of the primary winding coil 32 and the secondary winding coil 33 to be securely connected thereupon.

In the present embodiment, the first winding window portion 311 and the second winding window portion 312 are integrally formed, and the first lateral plate 3111 of the first winding window portion 311 is separated from the first lateral plate 3121 of the second winding window portion 312 by a specific distance d, wherein the value of the specific distance d is substantially set to 5 mm according to a preferred configuration of the present invention. By separating the lateral plate 3111 from the lateral plate 3121 by the specific distance d, the safety distance of electricity between the primary winding coil 32 and the second winding coil 33 can be maintained when the primary winding coil 32 and the second winding coil 33 are respectively wound around the winding area 3113 of the first winding window portion 311 and the winding area 3123 of the second winding window portion 312, and thereby increase the leakage inductance of the transformer.

Referring to FIG. 3(*a*) again, the bobbin case 313 includes two chambers 3131 and 3132 which are separated by a partition plate 3133 and respectively corresponds to the first winding window portion 311 and the second winding window portion 312. The chambers 3131 and 3132 are capable of covering the first winding window portion 311 and the second winding window portion 312, and the partition plate 3133 is fittingly positioned in the gap between the first lateral plate 3111 of the first winding window portion 311 and the first lateral plate 3121 of the second winding window portion 312, so as to provide an isolation for the primary winding coil 32 and the secondary winding coil 33. This would further increase the safety distance of electricity between the primary winding coil 32 and the second winding coil 33. In addition, the bobbin case 313 further includes a first opening 3134 and a second opening 3135 that are respectively communicable with the first chamber 3131 and the second chamber 3132 and are respectively located above the first winding area 3113 and the second winding area 3123. Accordingly, when the transformer is in operation, the heat generated by the transformer windings 32 and 33 can be dissipated from the first opening 3134 and the second opening 3135 so as to enhance the heat-dissipating efficiency of the transformer. Furthermore, the distance between the primary winding 32 as well as the secondary winding 33 and the external conductor is increased due to the sheathing functionality of the bobbin case 313, and thereby promote the electrical security of the transformer.

Referring to FIG. 3(*b*), which shows a transformer structure with a leakage inductance according to another embodiment of the present invention. In addition to the first winding window portion 311, the second winding window portion 312 and the bobbin case 313, the bobbin module 31 further includes a bottom plate 314 for separating the primary winding coil 32 within the first winding area 3113 and the secondary winding coil 33 within the second winding area 3123, as shown in FIG. 3(*b*). In the present embodiment, the bottom plate 314 is configured to extend upwardly to form a flange 3141 which is fittingly positioned in the gap between the first lateral plate 3111 and the first lateral plate 3121, so that the primary winding coil 32 is separated from the secondary winding coil 33. This would further increase the safe distance of electrical security between the primary winding coil 32 and the secondary winding coil 33.

Figure 4:
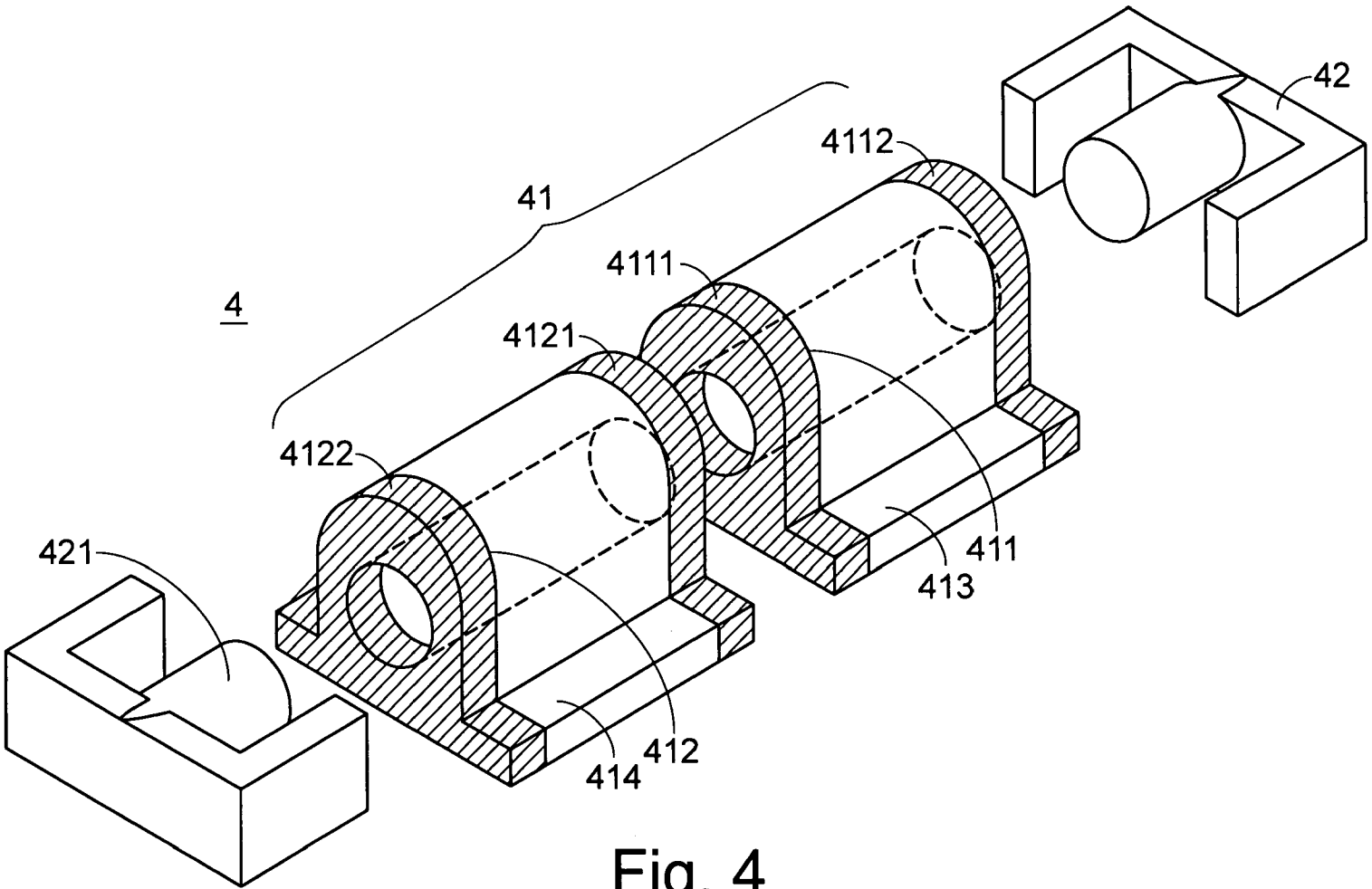
FIG. 4 illustrates a transformer structure with a leakage inductance according to yet another preferred embodiment of the present invention.

Referring to FIG. 4, a transformer structure with a leakage inductance according to yet another embodiment of the present invention is illustrated. As shown in FIG. 4, the transformer 4 includes a bobbin module 41, a primary winding coil (not shown), a secondary winding coil (not shown), and a magnetic core assembly 42, in which the bobbin module 41 includes a first winding window portion 411 and a second winding window portion 412. The embodiment of FIG. 4 differentiates from the embodiment of FIG. 3 in the respect that the first winding window portion 411 and the second winding window portion 412 are separated with each other instead of being integrally formed. In the present embodiment, the primary winding coil and the secondary winding coil are wound around the winding area (now shown) within the first winding window portion 411 and the winding area (not shown) within the second winding window portion 412, respectively, and are coated with a sheathing 413,414 respectively for the purpose of isolation. The magnetic core assembly 42 is shaped in the form of an EE-core, an EI-core, an ER-core, or a UU-core, in which a central leg 421 thereof is mounted within the bobbin module 41 so that the magnetic core assembly 41 can achieve a magnetic coupling effect with the primary winding coil and the secondary winding coil, and thereby performing voltage transformation. In addition, both of the first winding window portion 411 and the second winding window portion 412 include a first lateral plate 4111,4121 and a second lateral plate 4112,4122, respectively, in which winding areas are individually formed between the first lateral plate 4111,4121 and the second lateral plate 4112,4122 to allow the primary winding coil and the secondary winding coil to be wound thereupon.

The foregoing transformer is fabricated by way of the following manufacturing steps: first, winding a primary winding coil and a secondary winding coil around the first winding window portion 411 and the second winding window portion 412, respectively. Next, respectively coating the first winding window portion 411 and the second winding window portion 412 with a sheathing 413,414 to isolate the primary winding coil from the secondary winding coil, so that the primary winding coil and the secondary winding coil is protected by means of the sheathing. Afterwards, allowing the first winding window portion 411 and the second winding window portion 412 to be individually coupled or attached to the first lateral plate 4111,4121. Finally, combining the magnetic core assembly 42 with the first winding window portion 411 and the second winding window portion 412. With the above manufacturing steps, a transformer structure according to the present invention is obtained. When it is desired to employ the transformer structure of the present invention in a practical application, it can be done by mounting the transformer onto the designated location of the printed circuit board and establishing the electrical connection between the contact pins of the first winding window portion 411 as well as the contact pins of the second winding window portion 412 and the corresponding contacts on the printed circuit board.

It is known from the above statements that the first winding window portion 411 and the second winding window portion 412 can be separated with each other, and thereby the leakage inductance and the electrical security of the transformer can be regulated and maintained by adjusting the spacing distance between the first winding window portion 411 and the second winding window portion 412. In addition, in the present embodiment the transformer can serve as an independent circuit element by simply coating the first winding window portion 411 and the second winding window portion 412 with a sheathing. In this manner, not only the total height of the transformer is substantially reduced, but the manufacturing process of transformer is mechanized and automatized. Thus, the manpower expended in the manufacturing process can be saved, and the manufacturing process disclosed herein is suitable for mass production of the transformer.

While the present invention has been described in terms of what are presently considered to be the most practical and preferred embodiments, it is to be understood that the present invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A transformer structure comprising:

a primary winding coil;

a secondary winding coil;

a bobbin module including:

a first winding window portion and a second winding window portion, in which the first winding window portion allows the primary winding coil to be wound thereupon and the second winding window portion allows the secondary winding coil to be wound thereupon, and wherein both of first winding window portion and the second winding window portion include a first lateral plate, and the first winding window portion and the second winding window portion are separated or coupled by the first lateral plates thereof so as to separate the primary winding coil from the secondary winding coil; and a bobbin case for sheathing the first winding window portion and the second winding window portion, wherein the bobbin case includes at least two chambers being respectively corresponding to the first winding window portion and the second winding window portion for covering the first winding window portion and the second winding window portion, and the chambers are separated by a partition plate that is fittingly positioned in a gap formed between the first lateral plate of the first winding window portion and the first lateral plate of the second winding window portion; and a magnetic core assembly mounted within the bobbin module.

2. The transformer structure as claimed in claim 1 wherein the first winding window portion and the second winding window portion are integrally formed.

3. The transformer structure as claimed in claim 1 wherein the bobbin module further includes a bottom plate extending upwardly to form a flange that is fittingly positioned in the gap formed between the first lateral plate of the first winding window portion and the first lateral plate of the second winding window portion.

4. The transformer structure as claimed in claim 1 wherein the bobbin case further includes two openings being respectively communicable with the at least two chambers for dissipating the heat generated by the primary winding coil and the secondary winding coil.

5. The transformer structure as claimed in claim 1 wherein the first winding window portion and the second winding window portion are separated with each other.

6. The transformer structure as claimed in claim 1 wherein the magnetic core assembly is shaped in the form of an EE-core, an EI-core, an ER-core, or a UU-core.

7. The transformer structure as claimed in claim 1 wherein both of first winding window portion and the second winding window portion include a second lateral plate.

8. The transformer structure as claimed in claim 7 wherein for each first winding window portion and each second winding window portion, a winding area is individually provided between the first lateral plate and the second lateral plate of the first winding window portion, and provided between the first lateral plate and the second lateral plate of the second winding window portion.

9. The transformer structure as claimed in claim 7 wherein a lower part of the second lateral plate is configured to extend outwardly to from a contact pin portion.

10. The transformer structure as claimed in claim 9 wherein the contact pin portion includes a plurality of contacts.

* * * * *